US009803400B1

(12) United States Patent
Willie et al.

(10) Patent No.: US 9,803,400 B1
(45) Date of Patent: Oct. 31, 2017

(54) SPRINGLESS BALL AND CLUTCH LOCKING MECHANISM

(71) Applicant: LE VISE PRODUCTS LLC, Plano, TX (US)

(72) Inventors: Wu Willie, Fairview, TX (US); Yang Te-Chou, Kaohsiung (TW)

(73) Assignee: Le Vise Products LLC, Dallas, TX (US)

( * ) Notice: Subject to any disclaimer, the term of this patent is extended or adjusted under 35 U.S.C. 154(b) by 0 days.

(21) Appl. No.: 15/061,331

(22) Filed: May 16, 2016

(51) Int. Cl.
*E05B 73/00* (2006.01)
*A44C 5/18* (2006.01)

(52) U.S. Cl.
CPC ..... *E05B 73/0017* (2013.01); *A44C 5/18* (2013.01); *E05B 73/00* (2013.01); *E05B 73/0052* (2013.01)

(58) Field of Classification Search
CPC .. E05B 73/00; E05B 73/0017; E05B 73/0023; E05B 73/0029; E05B 73/0047; E05B 73/0052
See application file for complete search history.

(56) References Cited

U.S. PATENT DOCUMENTS 4,523,356 A * 6/1985 Charlot, Jr. ..... E05B 73/0017 24/706.8
4,531,264 A * 7/1985 Minasy ..... E05B 73/0017 24/707.6
4,590,461 A * 5/1986 Cooper ..... E05B 73/0017 139/119
4,903,383 A * 2/1990 Gartshore ..... E05B 73/0017 24/706.6
5,077,872 A * 1/1992 Guthammar ..... E05B 73/0017 24/704.1
5,497,639 A * 3/1996 Charlot, Jr. ..... E05B 73/0017 24/527
5,959,520 A * 9/1999 Stelter et al. ..... E05B 73/0017 335/306
7,073,236 B2 * 7/2006 Xue et al. ..... E05B 73/0017 24/704.1
7,821,403 B2 * 10/2010 Hogan ..... E05B 73/0017 70/33
8,117,874 B2 * 2/2012 McKeown ..... E05B 73/0017 24/704.1
8,573,011 B2 * 11/2013 Thoonsen ..... E05B 73/0017 70/57.1
9,053,623 B2 * 6/2015 Nguyen ..... E05B 73/0017

* cited by examiner

*Primary Examiner* — Christopher Boswell
(74) *Attorney, Agent, or Firm* — Phillip Black; James P. Dossey

(57) ABSTRACT

The invention relating to a locking mechanism is provided herein. The invention is composed of a pin adapted with a circumferential pin notch; a lock housing; a chamber with a chamber pin slot for receiving the pin and adapted to mate with the lock housing; a set of a given number of uniformly dimensioned ball bearings; a bearing housing adapted to fit inside the chamber, adapted to contain the ball bearings while enabling horizontal movement of the ball bearings and restraining vertical movement of the ball bearings, and adapted with a bearing housing pin slot for receiving the pin. When the pin is inserted into the chamber pin slot, the pin applies horizontal force to the ball bearings, which in turn deform the inside of the chamber. The ball bearings seat in the circumferential pin notch, locking the pin in place.

15 Claims, 4 Drawing Sheets

SPRINGLESS BALL AND CLUTCH LOCKING MECHANISM

BACKGROUND OF INVENTION

Field of the Invention

This invention relates to a ball and clutch locking mechanism.

Description of Related Art

Locking mechanisms have been developed using a ball-clutch design for restraining a pin from longitudinal movement (see U.S. Pat. No. 7,190,272 or U.S. Pat. No. 4,523,356). Such locking mechanisms are often used for securing antishoplifting tags to articles of merchandise. Ball-clutch locking mechanisms have also been used to secure child protection bracelets (see U.S. Pat. No. 6,472,989).

Current ball-clutch locking technology generally works through the use of an internal chamber containing a spring and ball bearings. When a pin is inserted into the chamber, the spring compresses, applying pressure to the internal ball bearings. The ball bearings under pressure form a friction clutch inside the chamber, locking the pin inside the chamber. To unlock the mechanism, a magnet is applied to the spring causing it to compress which in turn releases the internal ball bearings and allows removal of the pin.

Although the ball-clutch locking mechanism works well in a variety of settings, its complicated design adds unnecessary manufacturing time and expense. Furthermore, the spring acts as a single point of failure due to metal fatigue caused by repeated use of the lock. There is a need for a ball-clutch locking mechanism that does not include an internal spring.

BRIEF SUMMARY OF THE INVENTION

A locking mechanism is provided herein. The locking mechanism can be a ball-clutch mechanism and can be springless. The locking mechanism may be suited for use in securing wrist bands and does not include an internal compression spring. The present invention includes a chamber, a multitude of ball bearings, a bearing housing, and a pin.

The chamber can be made of a flexible material such as plastic. More particularly, the wall of the upper chamber can be made of a flexible material and/or the wall of the lower chamber can be made of a flexible material. The ball bearings and pin can be made of a strong, inflexible material such as steel, copper, or other metal. In one or more embodiments, the material used for the ball bearings and pin can be harder than the material of the chamber and or the walls of the chamber, including the inner upper chamber and inner lower chamber. The flexible material of the chamber wall can be useful to allow the ball bearings to push into the chamber walls as the pin is inserted into the locking mechanism. The pin will then be able to move into the chamber until the ball bearings move away from the chamber walls to engage the pin notch. Additionally, the ball bearings or bearing housing can be made of a magnetic material.

The invention can be locked, or otherwise secured into a locked position, by inserting the pin into the chamber. The pin has a notched end particularly suited for engaging ball bearings. When the pin is inserted into the chamber, the ball bearings and bearing housing ascend inside the chamber. The bearing housing ensures that the ball bearings maintain proper positioning within the chamber. When the pin reaches the proper position, the ball bearings engage the pin notch, locking the pin into place.

Because the material used for the ball bearings and pin can be harder than the material used for the chamber, the chamber is deformed slightly when the pin is inserted into the chamber to enable the ball bearings to seat into the notch on the pin. The seating of the ball bearings into the notch on the pin can result in an auditory or tactile click that informs the user that the device is locked.

The shape of the chamber can be tapered so that the end of the chamber where the pin is inserted is smaller than the opposite end of the chamber. Once the ball bearings are seated in the notch on the pin, the tapered shape of the chamber resists removal of the pin from the chamber.

To unlock the invention, a magnet is applied to the opposite side of the chamber from where the pin is inserted. The force of the magnet causes the ball bearings and bearing housing to ascend within the chamber. When the pin is extracted from the chamber, the force of the magnet resists the movement of the ball bearings and bearing housing, holding them to the end of the chamber. The extraction of the pin coupled with the application of the magnet causes the ball bearings to slightly deform the inside of the chamber so that the pin can be removed.

BRIEF DESCRIPTION OF THE SEVERAL VIEWS OF THE DRAWING(S)

DETAILED DESCRIPTION OF THE INVENTION

Figure 6:
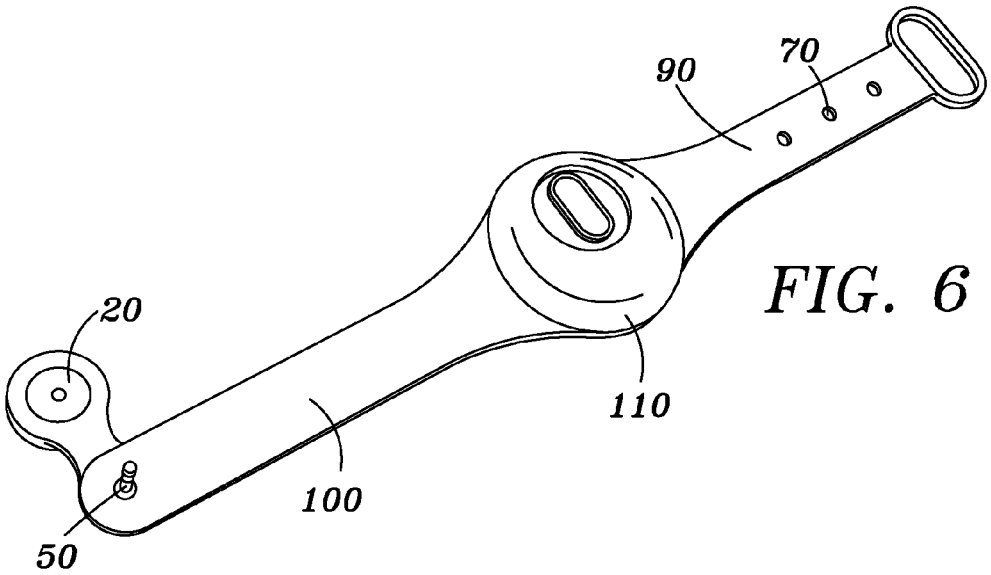
FIG. 6 depicts an isometric view of a wrist band utilizing the invention in the unlocked position.
Figure 7:
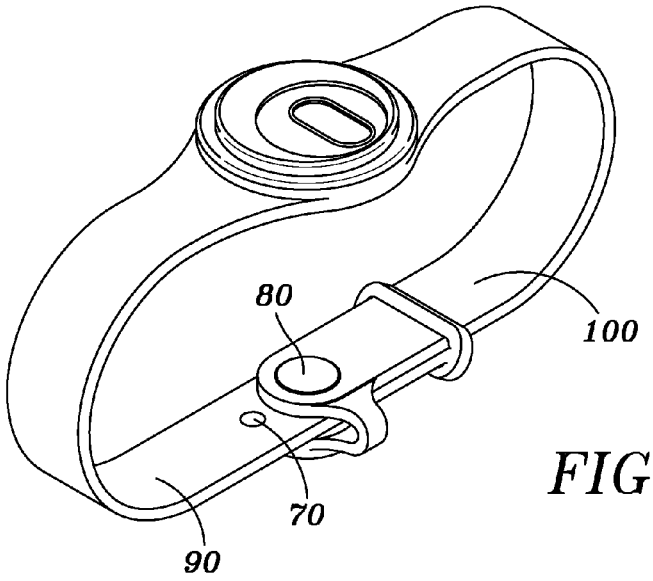
FIG. 7 depicts an isometric view of a wrist band utilizing the invention in the locked position.
Figure 8:
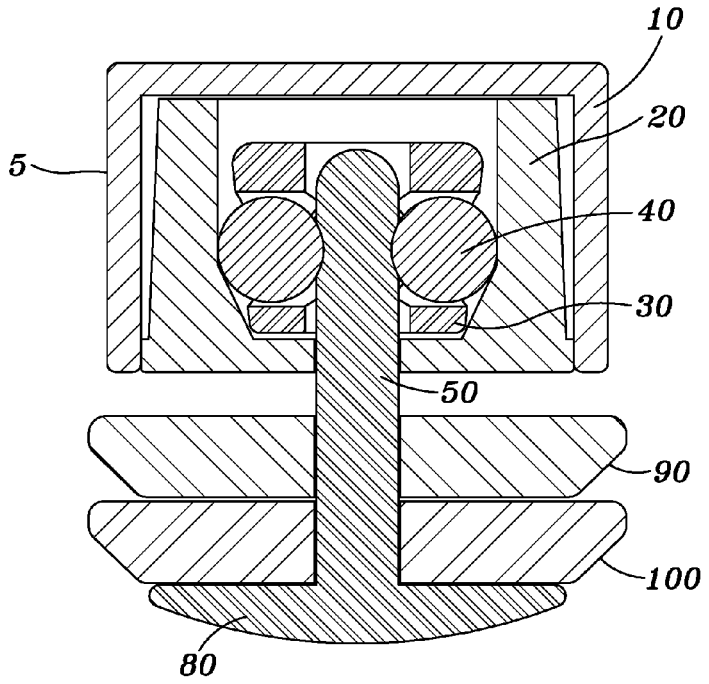
FIG. 8 depicts a side cross-sectional view of the invention in the locked position as utilized in a wrist band.

FIG. 1 through FIG. 8 illustrate an embodiment of the present invention. As shown in FIG. 8, the present invention consists of two primary components, a locking mechanism 5 and one or more pins 50.

Figure 1:
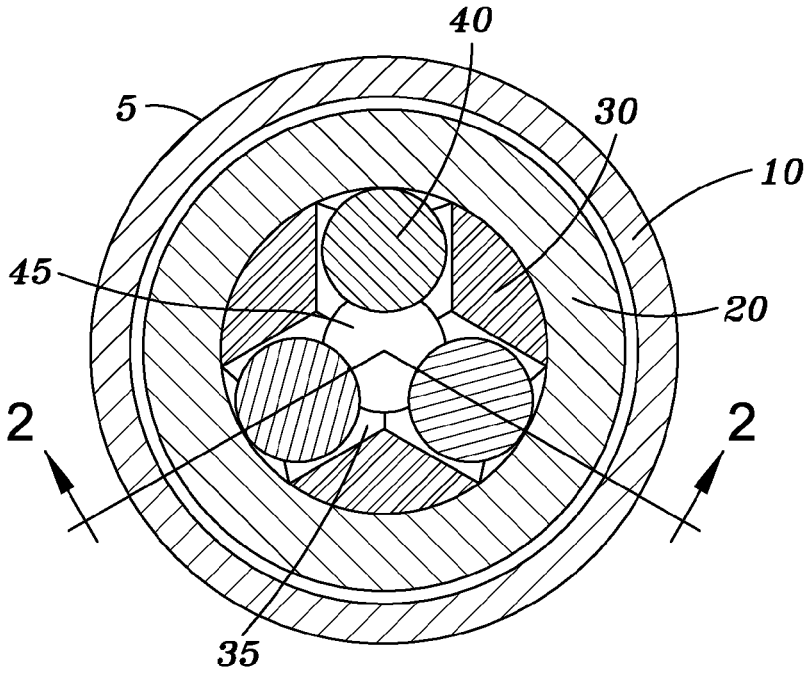
FIG. 1 depicts a top cross-sectional view of the invention.
Figure 2:
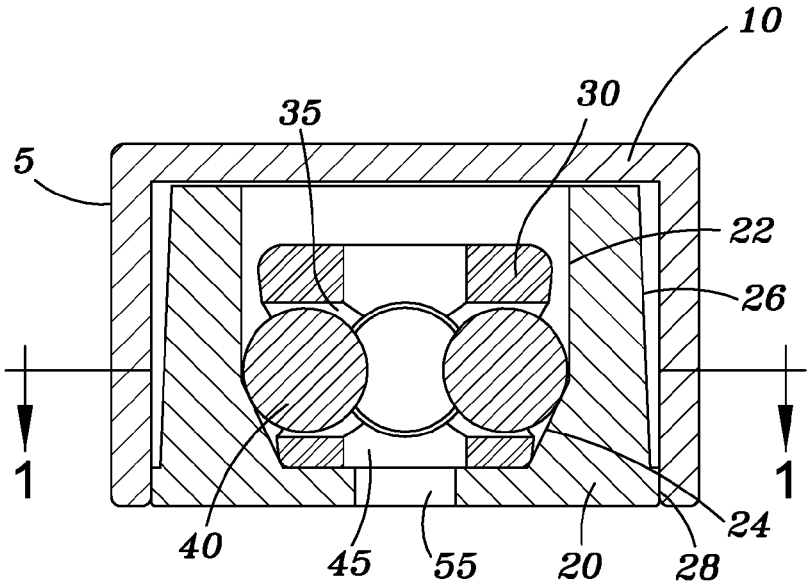
FIG. 2 depicts a side cross-sectional view of the invention without the pin inserted.

FIG. 1 and FIG. 2 illustrate the locking mechanism 5 in top and side cross-sectional views, respectively. A lock housing 10 can form the outer casing of the locking mechanism 5. The lock housing 10 can be made of a strong, lightweight, corrosion resistant material such as metal or hard plastic to resist deformation, fatigue, and corrosion. The lock housing 10 can be circular in shape, although other shapes such as rectangular, octagonal, or triangular also may be used. The lock housing 10 can be composed of magnetic material; however, if the lock housing 10 is not composed of magnetic material, it can be adapted such that a magnet 60, when applied to the outside of the lock housing 10, exacts an electromagnetic force on a bearing housing 30 and/or a ball bearing 40 within a chamber 20.

Referring to FIG. 2, the chamber 20 consists of an inside portion and an outside portion. The outside portion of the chamber 20 can be configured to mate with the lock housing 10 to form an enclosure for the other components of the locking mechanism 5. The chamber 20 can include an upper portion and a lower portion. The upper portion of the chamber can include an outer upper portion 26 and an inner upper portion 22. The lower portion of the chamber 20 can include an outer lower portion 28 and an inner lower portion 24. The outer lower chamber 28 can slightly wider than the outer upper chamber 26 so that the outer upper chamber 26 can slide inside the lock housing 10 and the outer lower chamber 28 forms a tight fit with the lock housing 10. As shown in FIG. 1, the chamber 20 can be circular in shape, although other shapes such as rectangular, octagonal, or triangular also may be used. The chamber 20 should made of a strong, lightweight, corrosion resistant material such as metal or hard plastic to resist deformation, fatigue, and corrosion.

A chamber pin slot 55 can be a circular hole disposed in the center of the bottom portion of the chamber 20 particularly suited for receiving the pin 50. The chamber pin slot 55 can extend from the outside portion of the chamber 20 to the inside portion of the chamber 20.

The inside portion of the chamber 20 is designed to contain the bearing housing 30 and the ball bearings 40. The inside portion of the chamber 20 is composed of two portions, an upper portion of the chamber 20 and a lower portion of the chamber 20. The inner upper chamber 22 can be straight-walled, forming a cylindrical shape on the inside of the top of the chamber 20. The inner lower chamber 24 can be conical in shape, with the larger side of the cone towards and integrating with the inner upper chamber 22. The smaller side of the cone faces the portion of the chamber 20 with the chamber pin slot 55.

The bearing housing 30 can be configured to hold and/or contain one or more ball bearings 40. The bearing housing 30 maintains the relative positions of the ball bearings 40 using a plurality of the bearing slots 35. The bearing slots 35 can designed so that the ball bearings 40 may move horizontally but not vertically within bearing housing 30. Bearing housing 30 can have one or more bearing slots 35, two or more bearing slots 35, three or more bearing slots 35, four or more bearing slots 35, five or more bearing slots 35, six or more bearing slots 35, seven or more bearing slots 35, eight or more bearing slots 35, nine or more bearing slots 35, or ten or more bearing slots 35. The bearing housing 30 can have any number of bearing slots 35 and can be configured such that the number of bearing slots 30 is the same as the number of ball bearings 40 disposed therein.

Referring to FIG. 2, the bearing housing pin slot 45 can extend vertically, or in a generally vertical direction, through the center of the bearing housing 30. The bearing slots 35 can intersect with the bearing housing pin slot 45 so that the ball bearings 40 may contact the pin 50 when the pin 50 is inserted into the bearing housing pin slot 45.

As shown in FIG. 1, the bearing housing 30 can be circular in shape, although other shapes such as rectangular, octagonal, or triangular also can be used. The Bearing housing 30 can be made of a strong, a lightweight, and/or a corrosion resistant material such as metal or hard plastic to resist deformation, fatigue, and/or corrosion.

As seen in FIG. 2, the ball bearings 40 are housed in the bearing slots 35 within the bearing housing 30. The invention can utilize three ball bearings 40, but can have any number of ball bearings 40. For example, the invention can utilize one ball bearing 40, two ball bearings 40, three ball bearings 40, four ball bearings 40, five ball bearings 40, six ball bearings 40, seven ball bearings 40, eight ball bearings 40, nine ball bearings 40, ten ball bearings 40, or eleven ball bearings 40. The ball bearings 40 can be made of a strong, lightweight, and/or corrosion resistant material such as metal and/or hard plastic to resist deformation, fatigue, and/or corrosion. In one or more embodiments, the material used for the ball bearings 40 can be harder than the material used for the chamber 20. In one or more alternative embodiments, the material used for the chamber 20 can be harder than the material used for the ball bearings 40. Both the bearing housing 30 and the ball bearings 40 can be composed of magnetic material. In one or more embodiments, at least one of the bearing housing 30 and the ball bearings 40 can be composed of or otherwise contain magnetic material.

Figure 3:
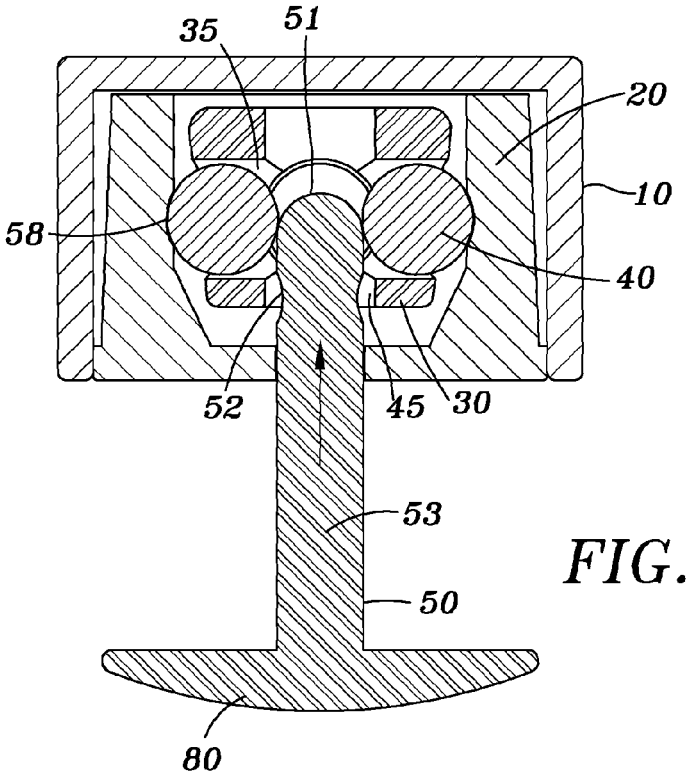
FIG. 3 depicts a side cross-sectional view of the invention during the insertion of the pin.

Referring to FIG. 3, the pin 50 is comprised of a pin head 51, a pin notch 52, a pin shaft 53, and/or a pin cap 80. The pin cap 80 can be a flat, circular shape. The pin head 80 can be generally perpendicular to, or otherwise intersect, the pin shaft 53. As shown in FIG. 3, the pin shaft 53 can be cylindrical in shape, although other shapes may be used.

The pin head 51 can be positioned on an opposite end of the pin shaft 53 from the pin cap 80. The pin head 51 can be generally spherical in shape, but other shapes may be used. The pin head 51 can have a relatively smooth surface to enable the insertion of the pin shaft 53 into the bearing housing pin slot 45 and/or to reduce friction between the pin shaft 53 and the ball bearings 40.

The pin notch 52 can be positioned adjacent to the pin head 51. The pin notch 52 can have a curved shape and/or extend around the circumference of pin shaft 53. The pin notch can be configured to engage the ball bearings 40.

The pin 50, including pin cap 80, pin head 51, and/or pin shaft 53, can be made of a strong, lightweight, and/or corrosion resistant material such as metal or hard plastic to resist deformation, fatigue, and/or corrosion.

FIG. 3 illustrates the method for locking the locking mechanism 5. The pin 50 can be inserted into and through the chamber pin slot 55. The pin 50 can then be moved into and through the bearing housing pin slot 45 and into an internal portion of the bearing housing 30. As pin head 51 enters bearing housing pin slot 45, the pin forces the ball bearings 40 to move in a generally horizontal and/or outward direction and through the bearing slots 35. In an embodiment where the inner walls of the chamber (include the inner upper chamber 22 and/or the inner lower chamber 24) are made of a flexible material, the ball bearings 40 can push into the chamber walls as the pin 50 is inserted into the locking mechanism 5. Using a flexible material for the chamber, or a portion of the chamber, provides the additional advantage of a spring-less locking mechanism. The pin 50 will then be able to move into the chamber until the ball bearings move away from the chamber walls to engage the pin notch 52. At the same time, the insertion of the pin 50 can cause the entire bearing housing 30 to move in a generally vertical and/or upward direction and through the chamber 20. As the ball bearings 40 reach the inner upper chamber 22, the force applied by the pin head 51 on the ball bearings 40 causes the ball bearings 40 to temporarily deform the inner upper chamber 22 at the point of contact. The inner upper chamber 22 deforms just enough so that the ball bearings 40 roll over the pin head 51 and become seated in the pin notch 52. In one or more embodiments, the seating of the ball bearings 40 in the pin notch 52 can cause an auditory and tactile "click", notifying the user that the lock has been engaged, securing the pin 50 within the chamber 20.

Figure 4:
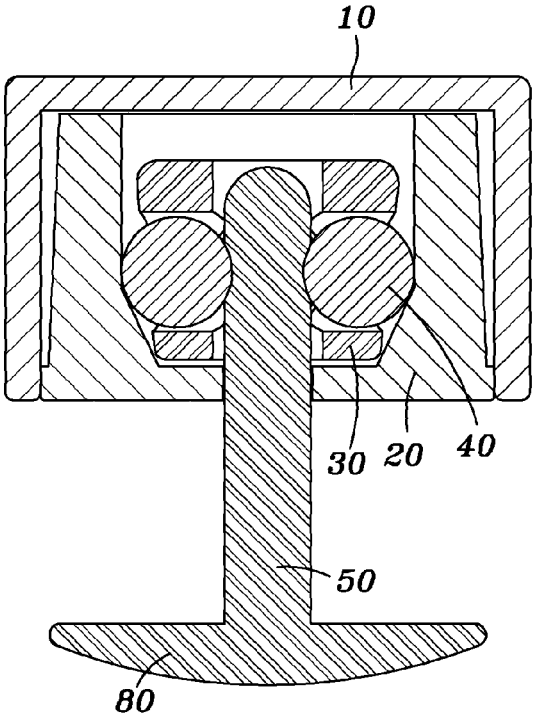
FIG. 4 depicts a side cross-sectional view of the invention in the locked position.

FIG. 4 shows the invention in the locked position. If force is applied to the pin 50 to remove it from the chamber 20, the bearing housing 30 moves downward, or in a generally vertical direction, within the chamber 20. The conical walls of the inner lower chamber 24 limit extraction of the pin 50 by creating friction between the inner lower chamber 24, the pin notch 52, and the bearing slot 35.

Figure 5:
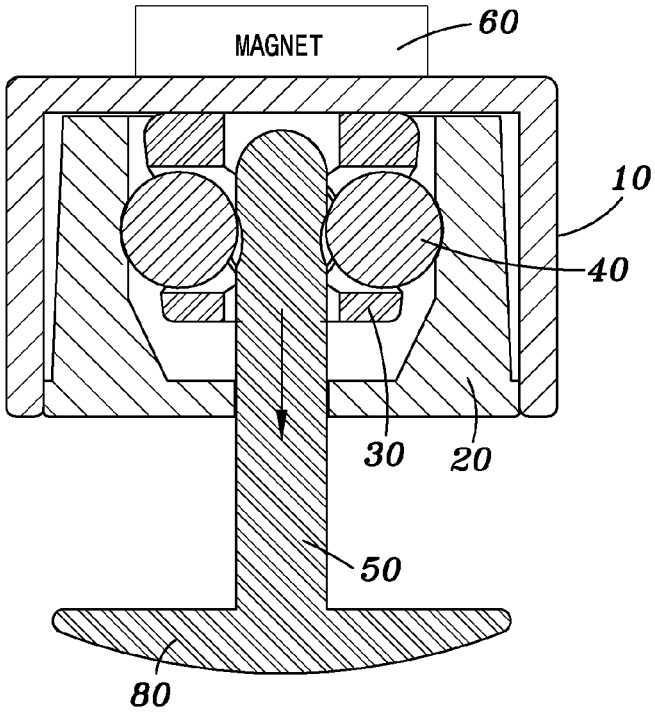
FIG. 5 depicts a side cross-sectional view of the invention showing unlocking process, including the application of the magnet and subsequent removal of the pin.

FIG. 5 illustrates the unlocking process. When the magnet 60 is applied to the side of the lock housing 10 opposite the chamber pin slot 55, the bearing housing 30, along with the ball bearings 40, move vertically to the top of the chamber 20. As a force is applied to the pin 50 pulling it out of the bearing housing 30, the pin head 51 forces the ball bearings 40 to move horizontally through the bearing slots 35. The force applied by the pin head 51 on the ball bearings 40 causes the ball bearings 40 to temporarily deform the inner upper chamber 22 at the point of contact. The inner upper chamber 22 deforms just enough so that the ball bearings 40 unseat from the pin notch 52 and roll over the pin head 51 to release the pin 50 from the bearing housing 30.

The invention has many possible uses, such as in security devices for retail clothing stores. FIG. 6 and FIG. 7 illustrate a wrist band 110 particularly suited for utilizing the invention. As shown in the illustrations, the invention is attached to a male wrist band strap 100. The wrist band 110 is attached to the wearer by connecting the male wrist band strap 100 with a female wrist band strap 90 by inserting the pin 50, located on the male wrist band strap 100, into an appropriate wrist band notch 70 located on the female wrist band strap 90. The invention is locked by inserting the pin 50 into the chamber pin slot 55 as described above. FIG. 8 shows a cross sectional view of the invention in the locked position with the pin 50 fastening the male wrist band strap 100 and the female wrist band strap 90.

The invention relating to a locking mechanism is provided herein. The invention is composed of a pin adapted with a circumferential pin notch; a lock housing; a chamber with a chamber pin slot for receiving the pin and adapted to mate with the lock housing; a set of a given number of uniformly dimensioned ball bearings; a bearing housing adapted to fit inside the chamber, adapted to contain the ball bearings while enabling horizontal movement of the ball bearings and restraining vertical movement of the ball bearings, and adapted with a bearing housing pin slot for receiving the pin. When the pin is inserted into the chamber pin slot, the pin applies horizontal force to the ball bearings, which in turn deform the inside of the chamber. The ball bearings seat in the circumferential pin notch, locking the pin in place.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A locking mechanism, comprising:
a spring-less body having a chamber disposed therein,
a bearing housing disposed within the chamber,
wherein the bearing housing comprises:
a bearing slot with a ball bearing disposed therein, and
a central pin slot for receiving a pin.

2. The locking mechanism of claim 1, the pin further comprising a pin notch, wherein the ball bearing locks the pin within the pin slot by engaging the pin at the pin notch.

3. The locking mechanism of claim 2, wherein the chamber comprises an upper portion and a lower portion, wherein the lower portion is conical in shape, and wherein the conical shape of the lower portion directs the ball bearing to engage the pin notch.

4. The locking mechanism of claim 3, wherein the ball bearing is disengaged from the pin notch by moving the bearing housing upward into the upper portion of the chamber.

5. The locking mechanism of claim 4, wherein the bearing housing is made of a magnetic material, and wherein the bearing housing is moved into the upper portion of the chamber by placing a magnet on a predetermined position of an outer surface of the body.

6. The locking mechanism of claim 3, wherein the pin is removed from the pin slot by moving the bearing housing into the upper portion of the chamber and moving the pin in an opposite direction.

7. A strap, comprising:
a first distal end comprising a spring-less locking mechanism;
a chamber disposed within the locking mechanism;
a bearing housing disposed within the chamber;
wherein the bearing housing comprises:
a bearing slot with a ball bearing disposed therein, and
a central pin slot and
a second distal end comprising a pin.

8. The strap of claim 7, wherein the bearing housing is configured to allow horizontal movement of the ball bearing and restrain vertical movement of the ball bearing.

9. The strap of claim 7, wherein the chamber comprises an upper portion and a lower portion and wherein the pin is removably disposed in the pin slot by moving the bearing housing into the upper portion and directing the pin within the pin slot.

10. The strap of claim 9, wherein the bearing housing is made of a magnetic material, and wherein the bearing housing is configured to move into the upper portion when a magnet is placed on the outer surface of the locking mechanism at a predisposed location.

11. The strap of claim 9, wherein the inner wall of the upper portion is made of a flexible material and configured to flex when the pin is inserted into the bearing housing.

12. A method for using a wrist band strap, comprising:
folding the wrist band strap such that a first distal end having a pin is proximal to a second distal end having a spring-less locking mechanism;
inserting the pin into a chamber disposed in a body of the spring-less locking mechanism, wherein the body comprises:

a bearing housing, wherein the bearing housing comprises:

a bearing slot with a ball bearing disposed therein, and a central pin slot for receiving the pin; and engaging a pin notch disposed on the pin.

13. The method of claim 12, wherein the ball bearing secures the pin within the bearing housing and wherein the pin can only be released by magnetic force.

14. The method of claim 12, wherein the chamber comprises an upper portion and a lower portion, and wherein the pin can only be removed from the bearing housing by moving the bearing housing into the upper portion of the chamber.

15. The method of claim 12, further comprising:

disengaging the pin by placing a magnet at a predisposed point about the external surface of the locking mechanism; and pulling the pin out of the pin slot.

* * * * *